US006655305B2

(12) United States Patent
Vogel et al.

(10) Patent No.: US 6,655,305 B2
(45) **Date of Patent: *Dec. 2, 2003**

(54) APPARATUS FOR THE EMBROIDERY OF SURFACE-SHAPED SEWING MATERIAL ON A COLUMN-TYPE, OR FREE ARM-TYPE, SEWING MACHINE INCLUDING DISTANCE ADAPTER

(75) Inventors: Hanspeter Vogel, Steckborn (CH); Andre Stucki, Steckborn (CH)

(73) Assignee: Fritz Gegauf AG Bernina-Nahmaschinenfabrik, Steckborn (CH)

( * ) Notice: Subject to any disclaimer, the term of this patent is extended or adjusted under 35 U.S.C. 154(b) by 231 days.

This patent is subject to a terminal disclaimer.

(21) Appl. No.: 09/768,698

(22) Filed: Jan. 24, 2001

(65) Prior Publication Data

US 2002/0014189 A1 Feb. 7, 2002

(30) Foreign Application Priority Data

Feb. 7, 2000 (CH) ..... 2000 0237/00

(51) Int. Cl.[7] ..... D05C 9/04; D05B 73/06; D05B 73/08

(52) U.S. Cl. ..... 112/103; 112/258

(58) Field of Search ..... 112/103, 102.5, 112/470.06, 470.14, 475.19, 475.18, 258, 260; 38/102.2

(56) References Cited

U.S. PATENT DOCUMENTS

| | | | | |
|---|---|---|---|---|
| 4,114,548 A | | 9/1978 | Kasahara et al. | |
| 5,040,476 A | * | 8/1991 | Takenoya | 112/168 |
| 5,906,168 A | * | 5/1999 | Ito et al. | 112/103 |
| 6,019,052 A | * | 2/2000 | Stucki et al. | 112/102.5 |

FOREIGN PATENT DOCUMENTS

| | | |
|---|---|---|
| DE | 78 02 259 U1 | 5/1978 |
| GB | 1313310 | 4/1973 |
| IT | 508764 | 7/1971 |

* cited by examiner

*Primary Examiner*—Peter Nerbun
(74) *Attorney, Agent, or Firm*—Edwin D. Schindler

(57) ABSTRACT

An apparatus for embroidering surface-shaped sewing material includes an embroidery device which is connected, via an intermediate insertion of a distance adapter, to the column or free arm of a sewing machine. By inserting the distance adapter between the embroidery device and the sewing machine the distance between the embroidery device and the free arm or the column of the sewing machine is increased, which makes it possible to use an embroidery frame having a cross-sectional surface which is significantly greater than an embroidery frame which is able to be used if there was simply a direct connection between the embroidery device and the free arm or column of the sewing machine.

10 Claims, 6 Drawing Sheets

APPARATUS FOR THE EMBROIDERY OF SURFACE-SHAPED SEWING MATERIAL ON A COLUMN-TYPE, OR FREE ARM-TYPE, SEWING MACHINE INCLUDING DISTANCE ADAPTER

BACKGROUND OF THE INVENTION

1. Technical Field of the Invention

The present invention relates, generally, to an apparatus for the embroidery of surface-shaped sewing material on a column-type, or free arm-type, sewing machine.

More particularly, the present invention relates to an apparatus for the embroidery of surface-shaped material on a free-arm sewing machine or a column sewing machine, which inventive apparatus includes a distance adapter capable of being docked onto the column, or the free arm, of the sewing machine with which an embroidery frame is able to be shifted in the X- and Y-directions by drive means, so that the entire surface of the sewing material clamped into the embroidery frame is able to be embroidered.

2. Description of the Prior Art

The production of embroidery patterns by using sewing machines, especially household sewing machines, is known. For that purpose, the surface-shaped sewing material, i.e., the embroidery substrate, is clamped into an embroidery frame and the embroidery frame is moved by a drive (capable of moving the embroidery frame in the X- and Y-directions) in accordance with the embroidery pattern.

The drive of the embroidery frame is located in a housing, which can be docked onto the free arm of the sewing machine. The housing is connected to the rear of the free arm and/or the base plate via a coupling, which provides the mechanical link. The embroidery frame, movable by the drive, normally features a width which is approximately equivalent to the distance between the sewing machine pillar and the needle, and a length which, in any event, amounts to double the width. This embroidery surface, which is relatively small and limited by the construction of the particular sewing machine, does not lend itself well to larger, continuous embroidery patterns; it is intended primarily for the embroidery of monograms or individual items.

In the case of single-purpose sewing machines and that of special sewing machines, which feature an integrated drive component for the embroidery frame in the area of the machine stand, the use of embroidery frames with two or four embroidery fields is known. Such embroidery frames feature two adjacent frame couplings each, and means by which the rectangular embroidery frame can be connected to the embroidery machine (or the embroidery-frame drive) at two adjacent points; the square embroidery frame, with four embroidery fields, features four couplings and can, therefore, be coupled at four points for the processing of one quadrant each. Alternatively, the offtakes can be infinitely shiftable and adjustable along the embroidery frame.

SUMMARY OF THE INVENTION

It is, therefore, an object of the present invention to provide an apparatus for the embroidery of surface-shaped sewing material on a column-type, or free arm-type, sewing machine, which is capable of being docked onto the column or free arm of the sewing machine and with which an embroidery frame is capable of being more readily shifted in the X- and Y-directions by drive means.

It is a further object of the present invention to provide an embroidery-frame drive for column-type sewing machines and free arm-type sewing machines, with which embroidery frames with single to multiple standard embroidery surfaces can be driven.

The foregoing and related objects are achieved by the inventive apparatus for the embroidery of surface-shaped sewing material on a free arm or column sewing machine, which includes an embroidery device. With the embroidery device, an embroidery frame is able to be shifted in the X- and Y-directions by drive means, so that the entire surface of the sewing material, which is clamped into the embroidery frame, is able to be embroidered. The claimed apparatus includes a distance adapter, which is inserted between the embroidery device, with the drive for the embroidery frame, and the sewing machine. The distance adapter increases the distance between the embroidery device and the needle of the sewing machine. A plurality of receiving accommodations are formed at the embroidery frame, so that with the receiving accommodations, the embroidery frame with its drive means is able to be connected to the embroidery device.

Inserting a distance adapter between the free arm or the column of the sewing machine and the embroidering device with the embroidering frame drive arranged in it, makes it possible to utilize, to the fullest extent, the space available between the needle axis and the pillar of the sewing machine on which the free arm is fixed.

In a preferred embodiment of the invention, the accessories box (in which the sewing utensils can be accommodated) and which is attached to the underarm when no narrow tube-shaped parts are being worked) forms the distance adapter. As a consequence, no additional machine parts must be stored or purchased in order to turn a sewing machine and an embroidering device into one whose use makes it possible to process embroidery surfaces several times larger.

Other objects and features of the present invention will become apparent when considered in combination with the accompanying drawing figures which illustrate certain preferred embodiments of the present invention. It should, however, be noted that the accompanying drawing figures are intended to illustrate only certain embodiments of the claimed invention and are not intended as a means for defining the limits and scope of the invention.

BRIEF DESCRIPTION OF THE DRAWING FIGURES

In the drawing, wherein similar reference numerals denote similar features throughout the several views.

DETAILED DESCRIPTION OF THE DRAWING FIGURES AND PREFERRED EMBODIMENTS

Figure 1:
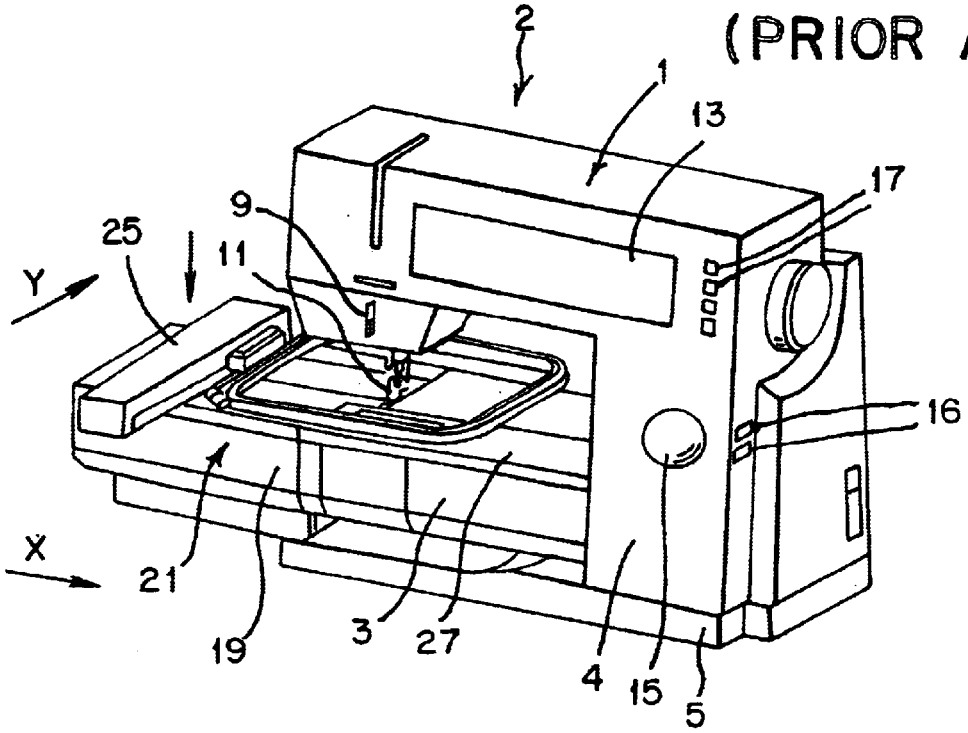
FIG. 1 (PRIOR ART)
FIG. 1 is a perspective view of a sewing machine, as known from the prior art, with a built-on embroidery device.

Turning now, in detail, to an analysis of the accompanying drawing figures, a free arm sewing machine 2 is shown in FIG. 1. The construction of this free arm sewing machine will not be explained in detail, since it is conventional to the prior art. Only parts of sewing machine 2 that are necessary for an understanding of the invention will be designated by reference symbols and explained in detail. In contrast to the free arm sewing machine 2, in the column sewing machine, the free space under the working and sewing surface is absent. In the case of a column sewing machine, a table surface, on which the pillar for the overarm is set, serves as the working and sewing surface.

In the accompanying drawing figures, reference numeral 1 designates the sewing machine housing, which is set onto a base plate 5, and features a substantially L-shaped form. The free arm 3 is formed on the vertical pillar 4 of the sewing machine housing 1, at a distance from base plate 5. At the free end of the free arm (not visible), underneath a stitch needle hole 7, a gripper is supported in a drivable manner. Above needle hole 7, a needle 11 is inserted on a needle rod 9. Facing the operator of the sewing machine, on the front side of machine housing 1, a monitor screen 13 is schematically represented as a rectangle. Alternatively, a differently embodied display, or operating unit, can also be provided. Also provided on the same side of the sewing machine housing 1 is a rolling ball 15. The associated operating keys are designated by reference numeral 16. A further row of keys 17 serves for the purpose of selecting special functions. None of the elements needed to guide the thread, nor the thread itself, are shown, inasmuch as they are not needed for a complete understanding and description of the present invention.

An embroidery device 21 is linked to the front end 19 of the free arm 3. Embroidery device 21 also lies completely against the rear side 23 of the free arm 3 and is mechanically connected to the sewing machine 2 by coupling means (not shown.) An embroidery frame carrier 25 is supported on the embroidery device 21 in a manner capable of being driven in the X-direction. Furthermore, an embroidery frame 27, capable of being driven in the Y-direction, is supported on the embroidery frame carrier 25. The drive elements for the embroidery frame 27 is a feature known to the prior art, e.g., German Utility Model Patent No. 29 614 512. A variety of other drive means for the X/Y movements of an embroidery frame are amply known from the prior art and will, therefore, not be explained in greater detail herein.

Figure 2:
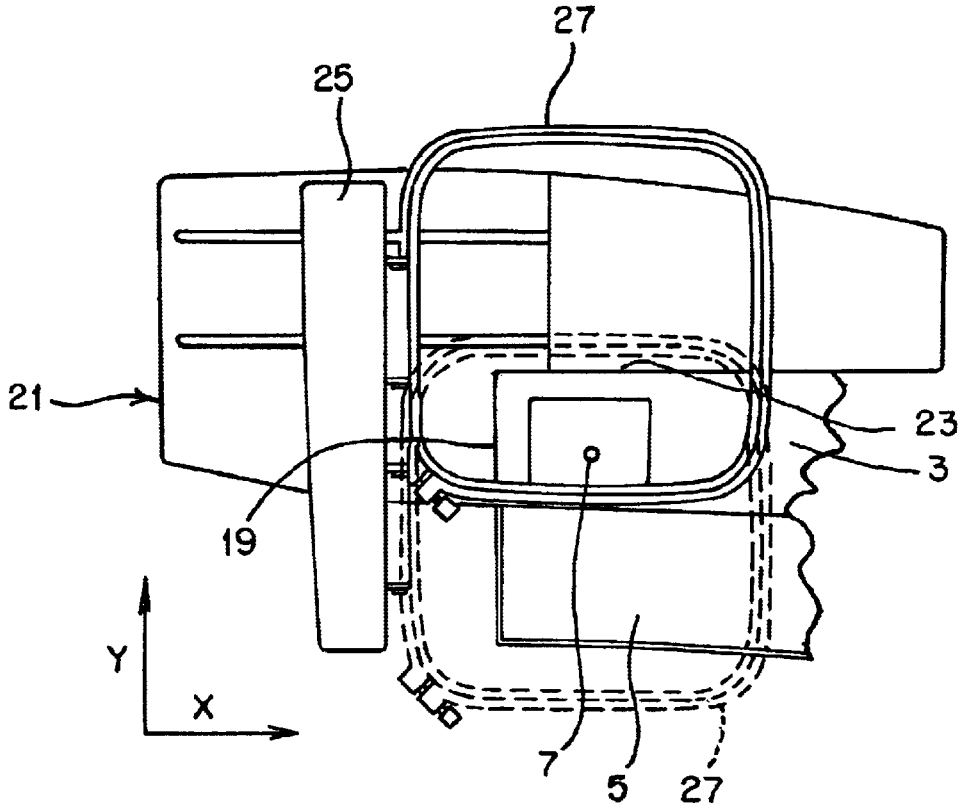
FIG. 2 (PRIOR ART)
FIG. 2 is a top view of the area of the free arm of the sewing machine and of the embroidery device that is attached directly to the free arm according to FIG. 1.
Figure 3:
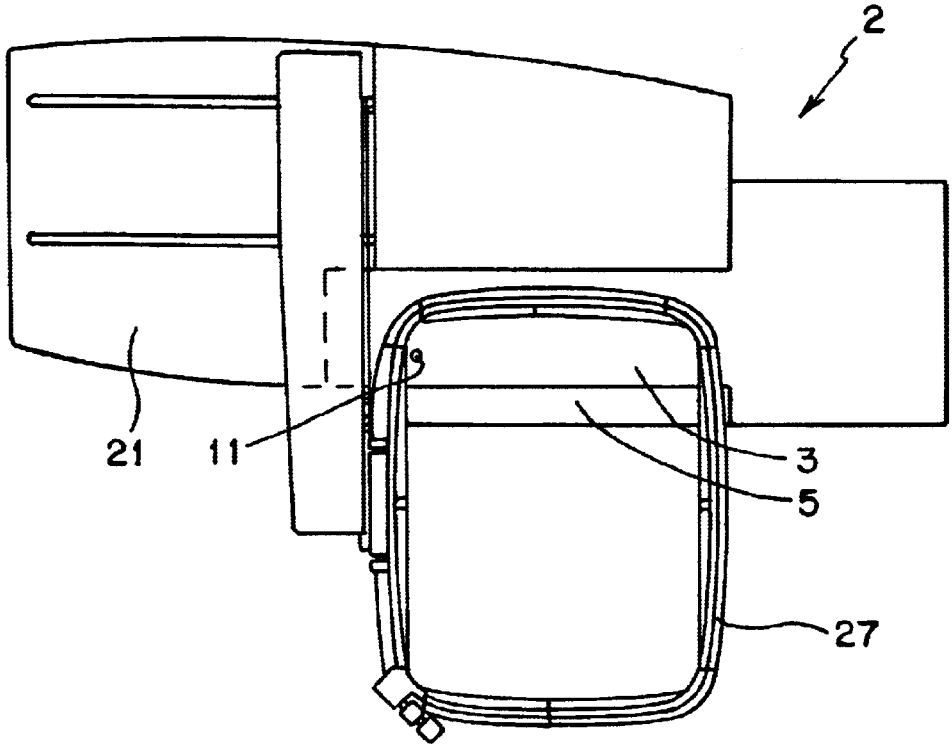
FIG. 3 (PRIOR ART)
FIG. 3 is a schematic representation of the arrangement of the embroidery device on the sewing machine according to FIG. 2.

By way of an appropriately designed control, embroidery frame 27 can be made to travel in a known manner on a programmable path. Using sewing machine 2, one can accordingly produce freely programmable patterns on a textile product clamped into embroidery frame 27. The mutual position between the embroidery device 21 and the free arm 3 of the sewing machine 2, shown in FIGS. 1–3, is in accordance with the prior art.

The schematic representations in FIGS. 4–11 show only the parts essential to the present invention, or the outlines of the sewing machine 2 and the embroidery device 21.

Figure 4:
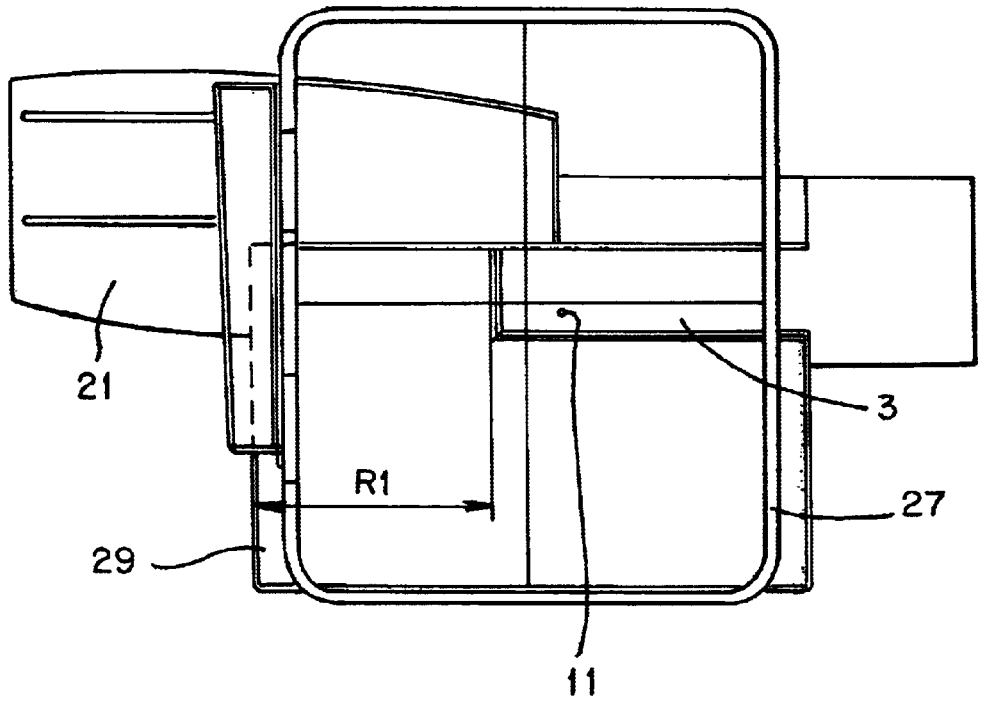
FIG. 4 is a schematic representation of a first embodiment of the presently claimed invention having a distance adapter with an embroidery device that is shifted in the sewing machine axis (X-direction)

In FIG. 4, which illustrates several of the features of the present invention, a distance adapter 29 has now been inserted between the embroidery device 21 and the free arm 3. Distance adapter 29 causes embroidery device 21 to come to lie in the lengthwise direction of free arm 3, i.e., in the X-direction, distanced before the sewing machine 2. This shift by the quantity R1 makes it possible to set onto embroidery device 21, an embroidery frame 27 having an edge length that is double the one shown in FIG. 2. In this position, needle 11 can penetrate into the embroidery area within embroidery frame 27, as far as the area's middle and, when seen in the Y-direction, can work on the entire quadrant A.

Figure 7:
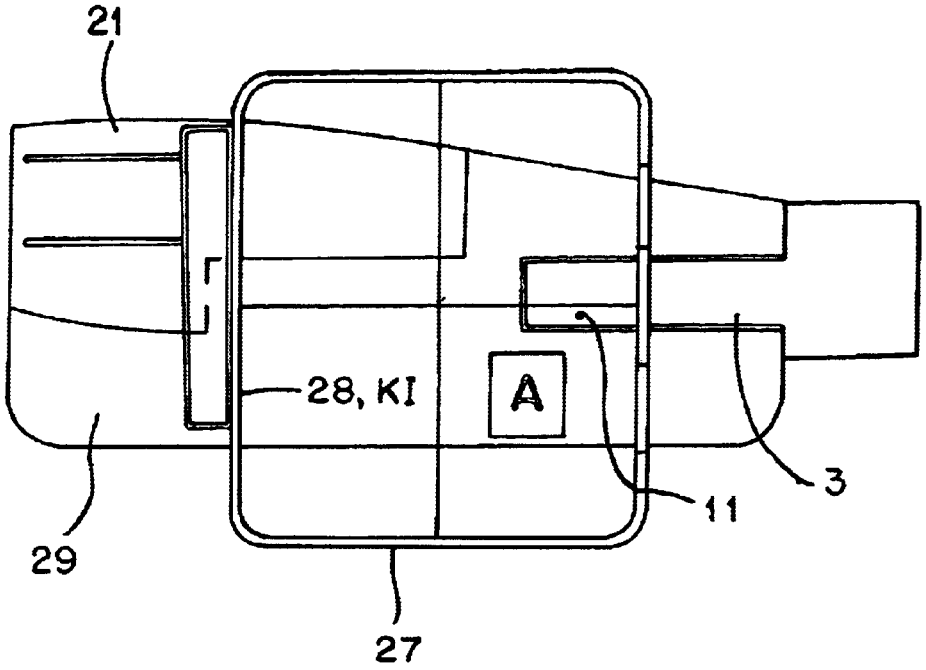
FIG. 7 is a schematic representation of the embroidery frame linked with the embroidery device according to FIG. 5 in a first working position, designated as position "A"
Figure 8:
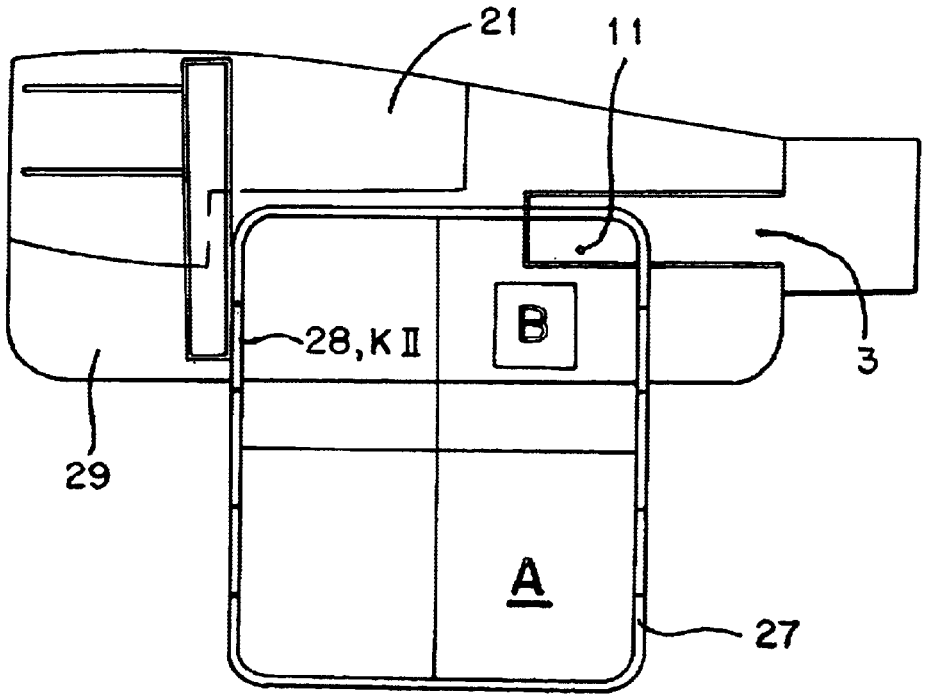
FIG. 8 is a schematic representation of the embroidery frame linked with the embroidery device according to FIG. 5 in a second working position, designated as position "B"
Figure 9:
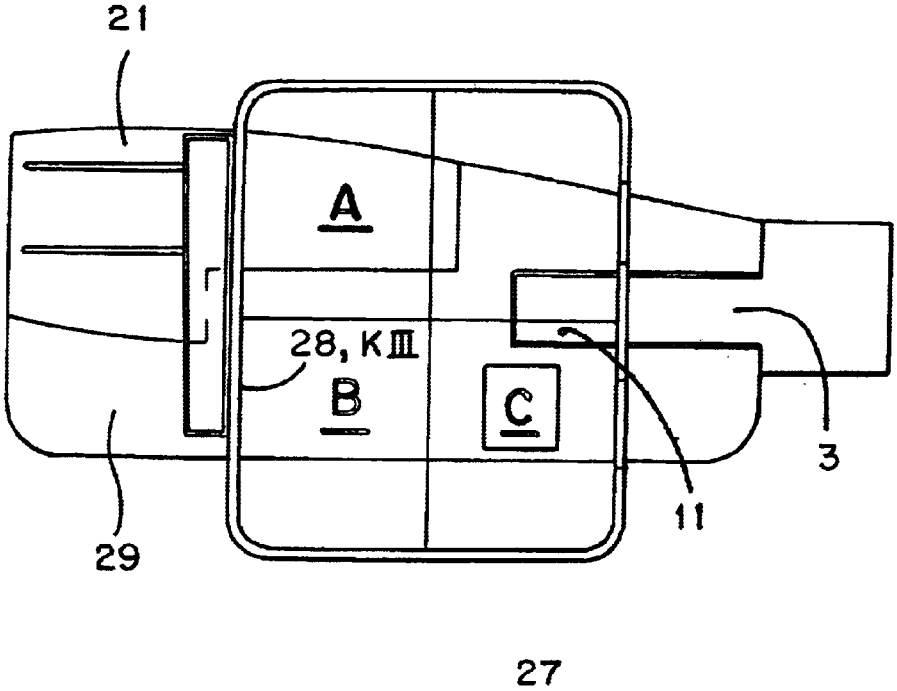
FIG. 9 is a schematic representation of the embroidery frame linked with the embroidery device according to FIG. 5 in a third working position, designated as position "C"
Figure 10:
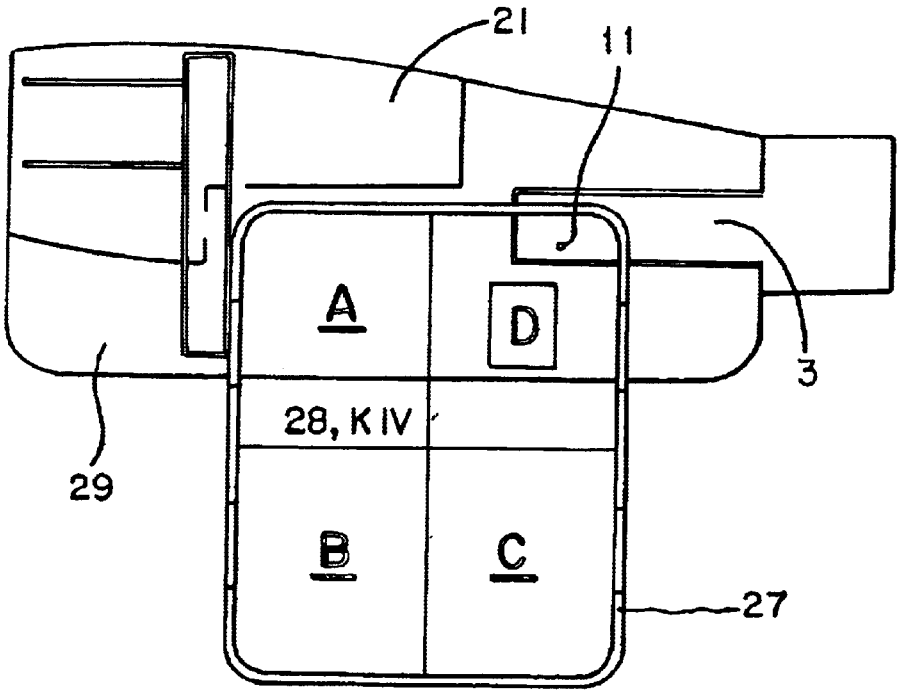
FIG. 10 is a schematic representation of the embroidery frame linked with the embroidery device according to FIG. 5 in a fourth working position, designated as position "D"

For working in the first quadrant "A," embroidery frame 27 is connected with the embroidery device at the point $K_I$ via a frame coupling 28 (see, FIG. 7.) For working in the second quadrant "B," embroidery frame 27 is attached at point $K_{II}$ (see, FIG. 9.) This yields a shift of the embroidery frame 27 in the Y-direction. FIG. 9 illustrates the situation in which embroidery frame 27 has been rotated 180° around its center and the work now proceeds on the third quadrant "C." Embroidery frame 27 is now attached to the embroidery device at the fastening point, or coupling point, $K_{III}$. In order to work the fourth quadrant, "D," the connection with the embroidery frame 27 is made at the point $K_{IV}$ (see, FIG. 10.) After the coupling switch, the adjustment of the embroidery frame 27, underneath needle 11, is made electronically via mechanical adjustment.

Figure 5:
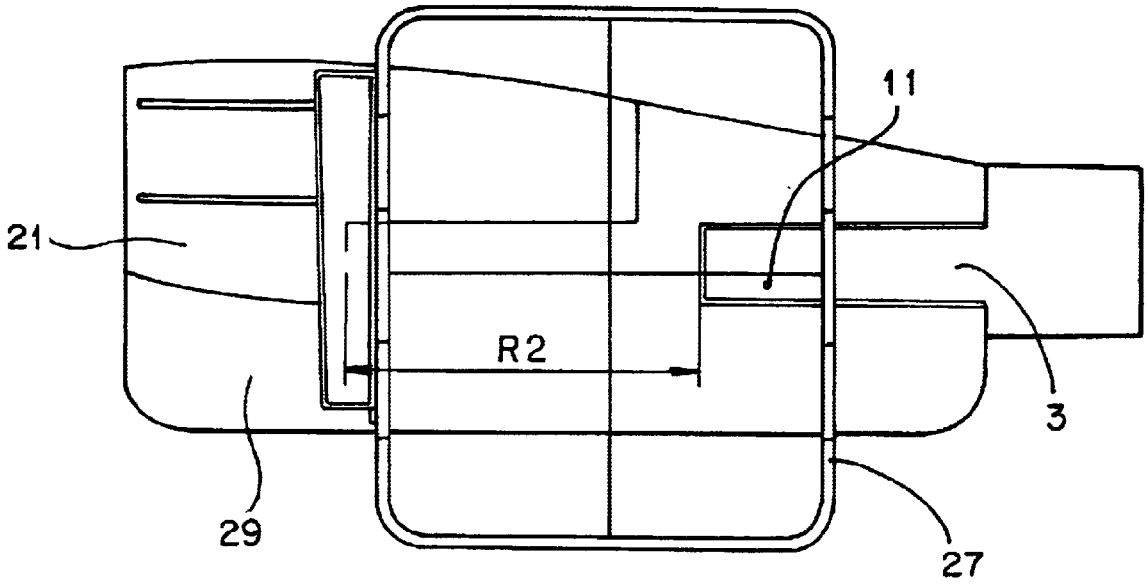
FIG. 5 is a schematic representation of a second embodiment of the presently claimed invention having an embroidery device that is fully shifted away from the free arm.

In the preferred embodiment of the invention illustrated in FIG. 5, the distance adapter 29 attaches the embroidery device 21 at a distance from the free arm 3 in the X-direction equal to the quantity $R_2$. Now there is no direct contact between embroidery device 21 and free arm 3. The distance adapter 29 surrounds the free arm 3 on three sides. Through this additional lateral distance, a correspondingly even larger embroidery frame 27 can be used.

Figure 6:
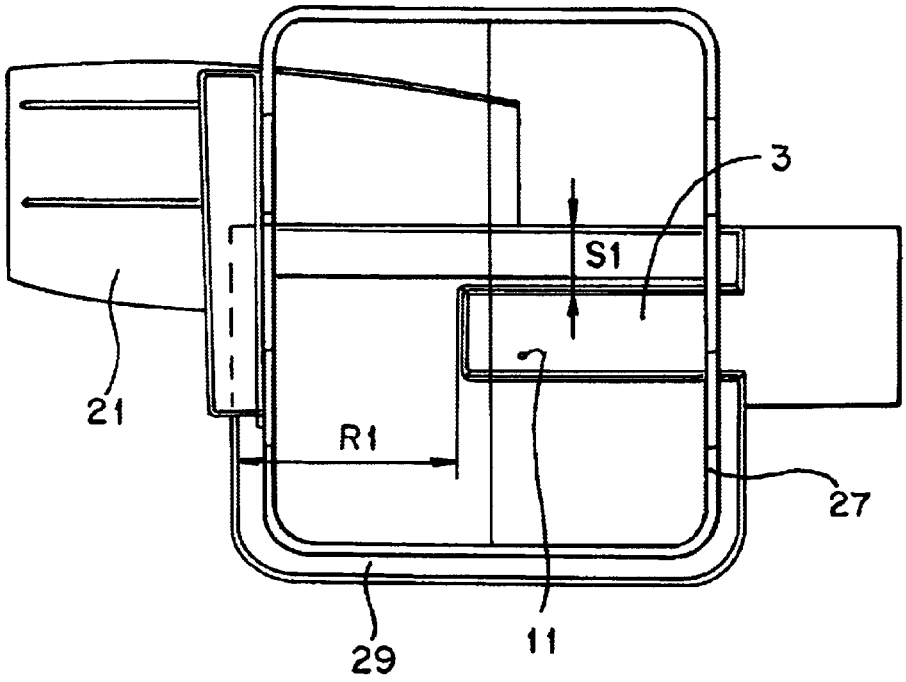
FIG. 6 is a schematic representation of a distance adapter with an embroidery device distanced both in the lengthwise axis and in the crosswise axis (X- and Y-directions)

In the preferred embodiment of the invention according to FIG. 6, there occurs a distancing of the embroidery device 21 from the free arm 3, both in the X-direction and in the Y-direction by the quantities $R_1$ and $S_1$.

Distance adapter 29 is connected, preferably, in a positive manner, via a first coupling means to free arm 3 and/or to the base plate 5, via a second coupling means to the embroidery device 21. These two coupling means are not visible in the drawing figures. The energy input for the drives in embroidery device 21 can be effected via the foregoing coupling means or via a cable to the embroidery device.

In a particularly advantageous embodiment of the present invention, the distance adapter 29 simultaneously serves as an accessories box. Alternatively, the accessories box (generally supplied with sewing machine 2), whose surface, linked with the free arm 3, increases the sewing surface, serves as the distance adapter. In this fashion, the accessories box alone must be equipped with the coupling means for the embroidery device 21, or else the distance adapter must feature a drawer or rotary draw, and inside contain the corresponding supports for the accessory parts.

Figure 11:
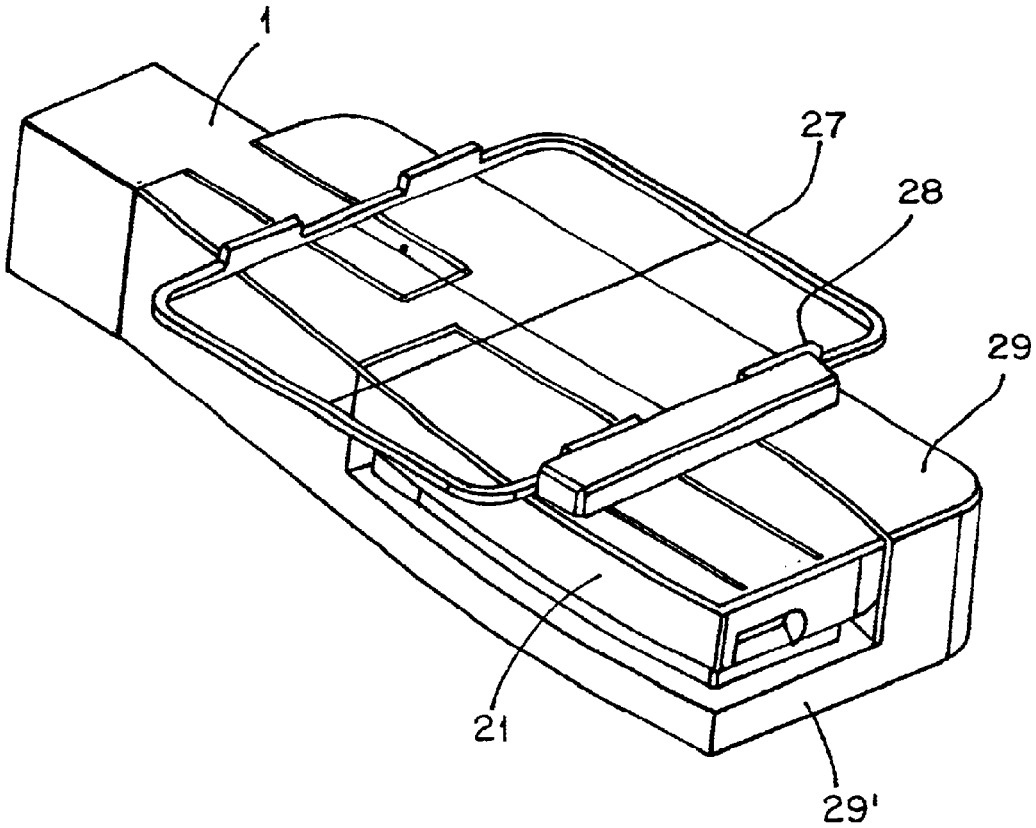
FIG. 11 is a perspective view of the embroidery device, which is set onto the distance adapter of the present invention; and, FIG. 12 is a perspective view of the embroidery device, wherein the sewing machine is set onto the distance adapter.

In FIG. 11, embroidery device 21 lies on an accommodating plate 29' that is arranged laterally on distance adapter 29. The accommodating plate makes it possible to also attach the embroidery device to sewing machine 2, in which the needle plate lies higher than the surface of the embroidery device 21.

Figure 12:
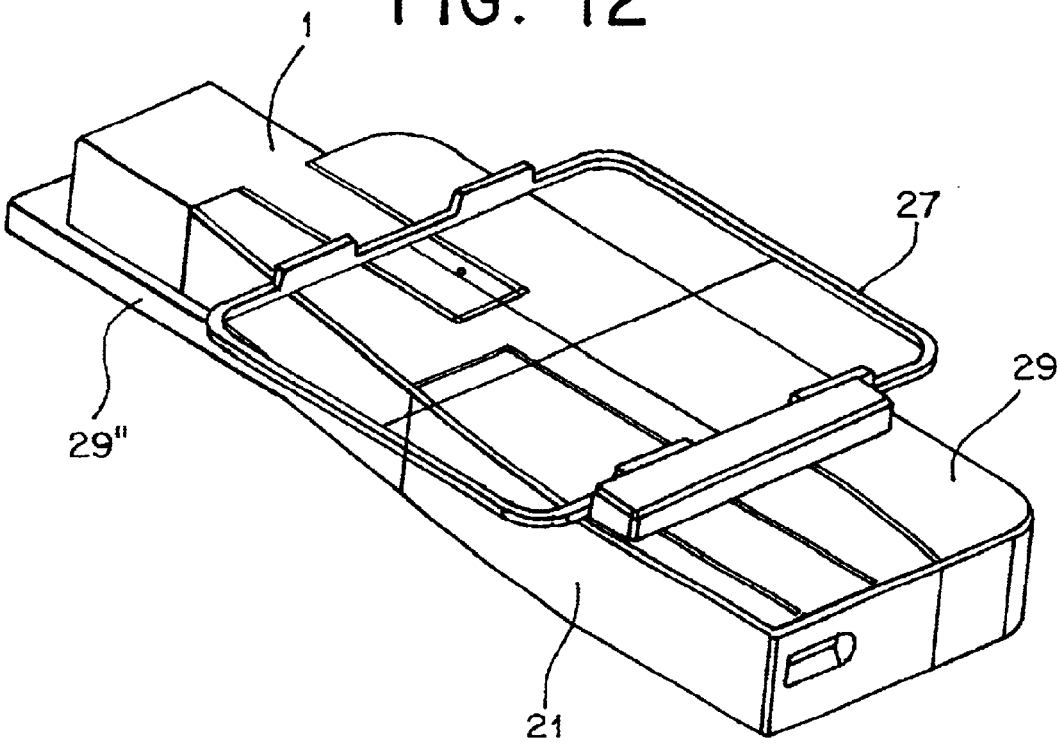

In FIG. 12, distance adapter 29 features, in its area that surrounds the sewing machine support with the needle hole plate, a bed plate 29". The latter makes it possible to set smaller sewing machine models, in which the sewing material support lies lower than the surface of embroidery device 21, onto the bed plate 29".

The accommodating plate 29' and the bed plate 29" can be a part of the distance adapter 29 or, in an alternative construction, can be made to be attachable to the distance adapter 29.

While only several embodiments of the present invention have been shown and described, it will be obvious to those skilled in the art that many modifications may be made to the present invention without departing from the spirit and scope thereof.

What is claimed is:

1. An apparatus for an embroidery of surface-shaped sewing material on a free arm sewing machine or a column sewing machine, comprising:

an embroidery device for a column or free arm of a sewing machine; and, a distance adapter inserted between said embroidery device and the column or the free arm of the sewing machine for increasing distance between said embroidery device and a needle for the sewing machine.

2. The apparatus for an embroidery of surface-shaped sewing material on a free arm sewing machine or a column sewing machine according to claim 1, further comprising:

an embroidery frame for clamping sewing material;

means for driving said embroidery frame in both an X-direction and a Y-direction; and, a plurality of receiving accommodations for said embroidery frame for connecting said embroidery frame with said means for driving to said embroidering device.

3. The apparatus for an embroidery of surface-shaped sewing material on a free arm sewing machine or a column sewing machine according to claim 1, wherein said distance adapter comprises first coupling means for docking onto the column of the sewing machine and second coupling means for docking said embroidery device onto said distance adapter.

4. The apparatus for an embroidery of surface-shaped sewing material on a free arm sewing machine or a column sewing machine according to claim 1, wherein said distance adapter comprises first coupling means for docking onto the free arm of the sewing machine and second coupling means for docking said embroidery device onto said distance adapter.

5. The apparatus for an embroidery of surface-shaped sewing material on a free arm sewing machine or a column sewing machine according to claim 1, wherein said distance adapter comprises first coupling means for docking onto a base plate of the sewing machine and second coupling means for docking said embroidery device onto said distance adapter.

6. The apparatus for an embroidery of surface-shaped sewing material on a free arm sewing machine or a column sewing machine according to claim 1, wherein said distance adapter is constructed as an accessories box for the sewing machine.

7. The apparatus for an embroidery of surface-shaped sewing material on a free arm sewing machine or a column sewing machine according to claim 1, further comprising a receiving plate for said embroidery device formed on said distance adapter.

8. The apparatus for an embroidery of surface-shaped sewing material on a free arm sewing machine or a column sewing machine according to claim 7, wherein said receiving plate is integrally formed with said distance adapter.

9. The apparatus for an embroidery of surface-shaped sewing material on a free arm sewing machine or a column sewing machine according to claim 1, further comprising a bed plate for accommodating the sewing machine which is formed at said distance adapter.

10. The apparatus for an embroidery of surface-shaped sewing material on a free arm sewing machine or a column sewing machine according to claim 9, wherein said bed plate is integrally formed with said distance adapter.

* * * * *